United States Patent [19]

Saia

[11] Patent Number: 4,887,406

[45] Date of Patent: Dec. 19, 1989

[54] STRUCTURAL MEMBER FOR BUILDINGS

[76] Inventor: Wilburn H. F. Saia, 2959 River Road, Rt. 4, Midland, Mich. 48640

[21] Appl. No.: 140,119

[22] Filed: Dec. 31, 1987

[51] Int. Cl.[4] ..... E04C 3/02

[52] U.S. Cl. ..... 52/694; 52/693; 52/729

[58] Field of Search ..... 52/693, 694, 729, 721, 52/726, 730

[56] References Cited

U.S. PATENT DOCUMENTS

| | | | |
|---|---|---|---|
| 2,004,894 | 6/1935 | Hughes | 52/694 X |
| 2,662,272 | 12/1953 | Macomber | 52/694 X |
| 3,478,474 | 11/1969 | Johansson . | |
| 3,747,290 | 7/1973 | Barrell et al. . | |
| 3,894,766 | 7/1975 | Woodward . | |
| 3,999,338 | 12/1976 | Behan, Jr. et al. . | |
| 4,192,108 | 3/1980 | Lowe . | |
| 4,285,175 | 8/1981 | Struben et al. . | |
| 4,476,662 | 10/1984 | Fisher | 52/726 X |
| 4,621,475 | 11/1986 | McClain | 52/694 X |

*Primary Examiner*—David A. Scherbel
*Assistant Examiner*—Creighton Smith
*Attorney, Agent, or Firm*—Learman & McCulloch

[57] ABSTRACT

A structural member that is adapted to be used as a joist purlin, or girt which is used in a roof, floor, or vertical support. The structural member comprises spaced apart, parallel chords joined to one another by spaced apart struts. Each chord is composed of a pair of angular elements having vertical flanges joined in back to back relation, the vertical flanges being joined to upper flanges which extend in opposite directions from the joined flanges and are either horizontal or inclined to correspond to the pitch of the roof.

24 Claims, 2 Drawing Sheets

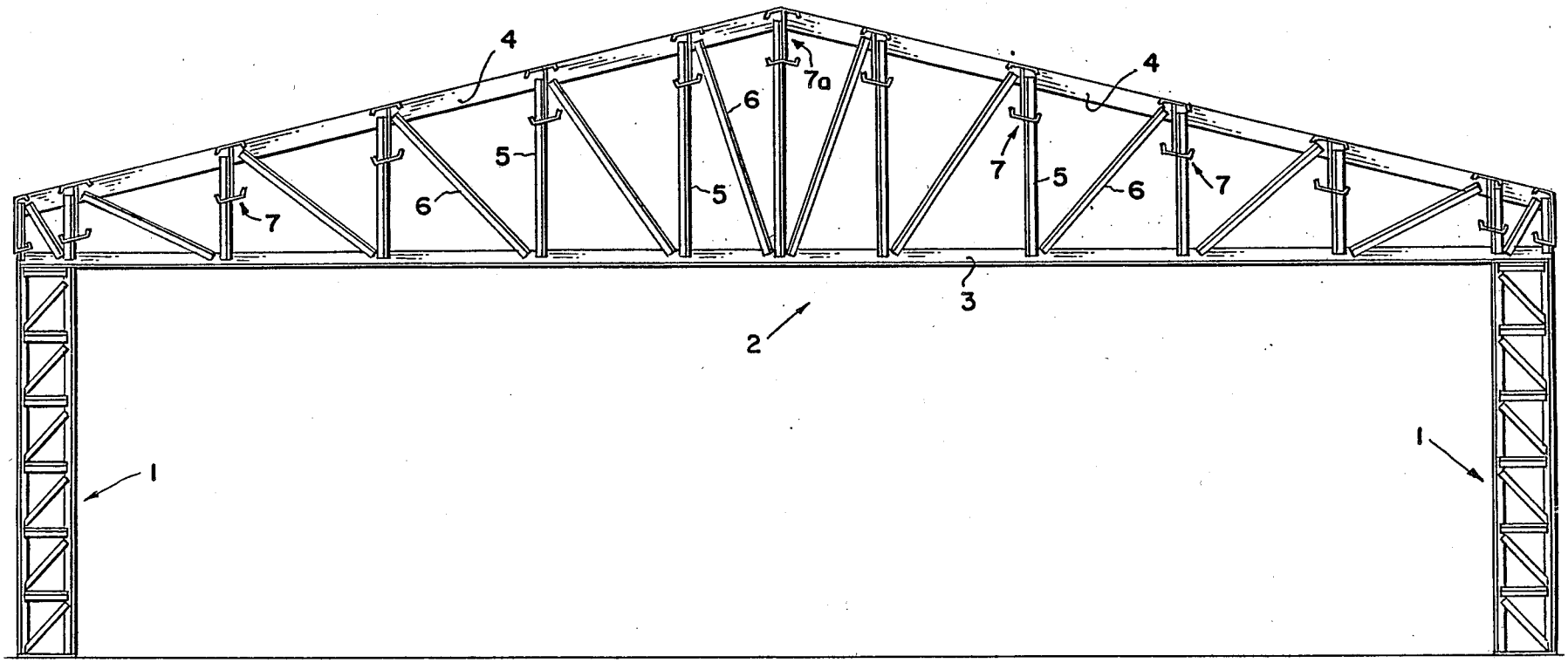
FIG.1
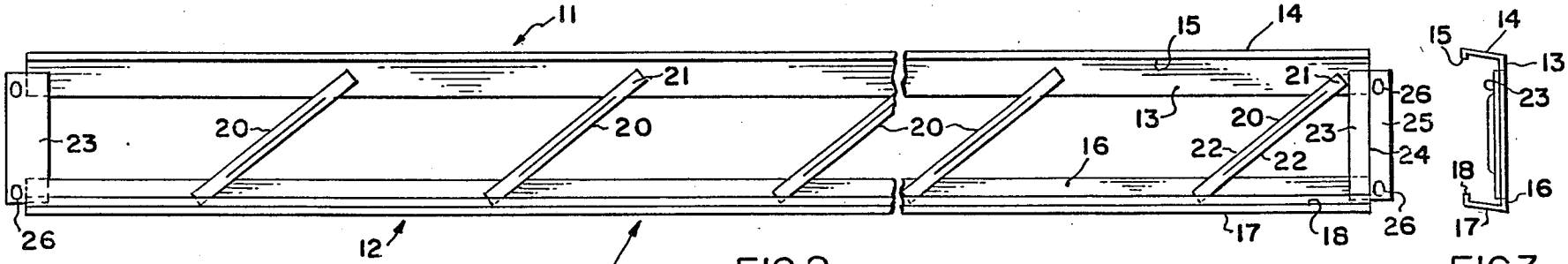
FIG.2
FIG.3

STRUCTURAL MEMBER FOR BUILDINGS

This invention relates to a structural member especially adapted for use as a joist, purlin, and girt in the construction of a building.

BACKGROUND OF THE INVENTION

A framed building conventionally has a roof or floor composed of spaced apart trusses or beams supported at their opposite ends on vertical frame members or walls. The space between adjacent trusses, beams, walls, or frame members is spanned by a plurality of structural members referred to as joists, purlins, and girts. When used between trusses and beams the structural members not only join the trusses and beams to one another, but their upper and lower chords provide support for the roof or floor decking and the lower chords provide support for insulation and ceiling panels. The structural members have webs or struts which join the upper and lower chords. When used between vertical frame members the structural members are placed perpendicular to the wall to support the wall material against lateral forces such as wind loading.

SUMMARY OF THE INVENTION

A structural member constructed in accordance with the invention is adapted for use as a joist, purlin, or girt, and is particularly adapted for use in the construction of a roof, a floor, or as a reinforcement for a vertical support.

The structural member preferably comprises spaced apart, parallel chords joined to one another by spaced apart struts. Each chord is composed of a pair of angular elements having vertical flanges joined in back to back relation, the vertical flanges being joined to upper flanges which extend in opposite directions from the joined flanges and are either horizontal or inclined to correspond to the pitch of the roof. The lower chord is constructed in the same manner as the upper chord, but the flanges which extend from the joined flanges are either horizontal or parallel to the flanges of the upper chord so as to provide either horizontal or pitched support for insulation and ceiling materials.

A structural member according to the invention has its upper and lower chords joined together at opposite ends by end plates formed with upwardly tapering openings that are adapted to accommodate button-headed attachment studs carried by the trusses.

The struts which join the upper and lower chords preferably are of right angular cross section and terminate at their opposite ends in flat surfaces which engage the respective chords.

Each structural member is formed from two similar halves which subsequently are assembled into a single unit.

THE DRAWINGS

A structural member embodying the preferred form of the invention is disclosed in the following description and the accompanying drawings wherein:

FIG. 1 is an elevational view of one end of a building frame incorporating structural members constructed in accordance with invention;

FIG. 2 is a fragmentary, front elevational view, on an enlarged scale, of one half of such a structural member;

FIG. 3 is an end elevational view of the unit shown in FIG. 2;

DETAILED DESCRIPTION

Figures 4, 5, 6, 7, 8, 9, 10, 11:
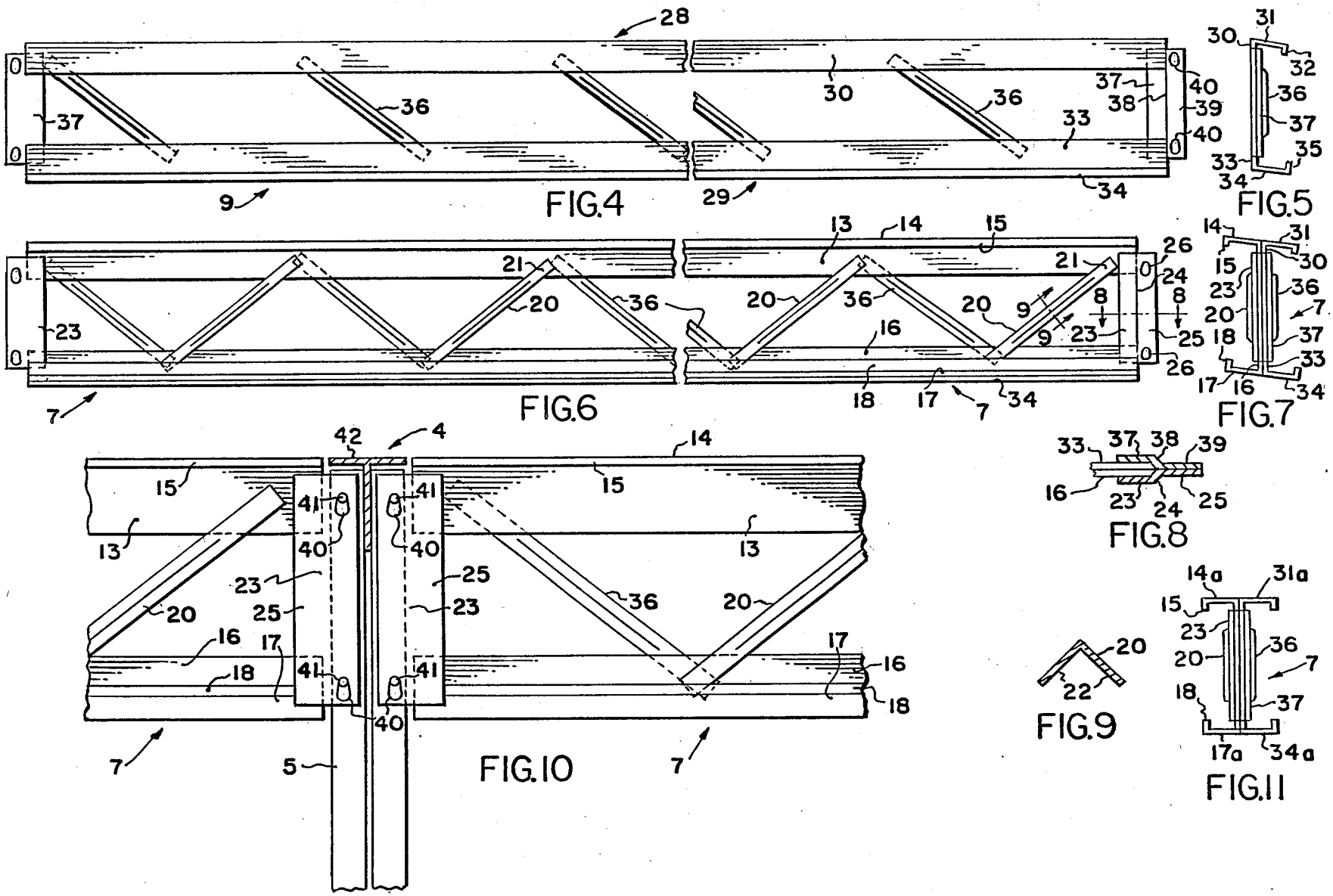
FIG. 4 is a fragmentary, front elevational view of the second half of the structural member.
FIG. 5 is an end elevational view of the unit shown in FIG. 4.
FIG. 6 is a fragmentary, elevational view of an assembled member.
FIG. 7 is an end elevational view of the assembled member.
FIG. 8 is a sectional view taken on the line 8—8 of FIG. 6.
FIG. 9 is a sectional view taken on the line 9—9 of FIG. 6.
FIG. 10 is a fragmentary, greatly enlarged, partly elevational and partly sectional view illustrating the manner in which two may be fixed to a roof truss.
FIG. 11 is an end elevational view of a structural member especially adapted for use as a girt.

A structural member formed in accordance with the invention is adapted for use in the construction of a building having spaced apart, parallel, vertical supports 1 on which is supported a plurality of spaced apart, parallel roof trusses 2 each of which has a horizontal beam 3 and a pitched top chord 4 joined to one another by suitable vertical and inclined braces 5 and 6, respectively, of right angular configuration as is conventional. Adjacent trusses 2 are joined to one another by transverse structural members 7 constructed in accordance with the invention.

Each structural member 7 is formed of two half units 8 and 9, respectively. Each unit 8 comprises an upper chord 11 and a lower chord 12, the upper chord comprising a vertical flange 13 from which extends an upper flange 14 terminating in a downwardly extending strengthening lip 15. The lower chord 12 has a vertical flange 16 from which extends a lower flange 17 terminating in an upwardly turned lip 18. Spanning the flanges 13 and 16 is a plurality of longitudinally spaced struts 20 each of which has flattened ends 21 and is creased to form a pair of right angular flanges 22 between its ends. All of the struts 20 are inclined to the vertical at a uniform angle and are secured to the respective flanges 13 and 16 by suitable means, preferably spot welding.

At each end of the unit 8 is an end plate 23 which preferably is spot welded to the respective flanges and is of such transverse dimension as to extend beyond the ends of the respective chords 11 and 12. As is best shown in FIG. 8, each end plate 23 is offset as at 24 between its side edges an amount corresponding substantially to the thickness of the flanges 13 and 16. That portion of the plate 23 which extends beyond the chords is designated 25. In that portion of each end plate 23 that extends beyond the chords is formed a pair of vertically spaced openings 26, each of which tapers upwardly.

The half unit 9 comprises an upper member 28 and a lower member 29. The upper member 28 has a vertical flange 30 to which is joined a flange 31 terminating in a downwardly turned lip 32. The member 29 has a vertical flange 33 joined to a flange 34 that terminates in an upwardly turned lip 35. The vertical flanges 30 and 33 are joined together by spaced struts 36 which, like the struts 20, are inclined to the vertical and at a corresponding angle. The inclination of the struts 36 is the reverse of that of the struts 20, but in all other respects the struts 20 and 36 are the same.

The members 28 and 29 also are joined together at corresponding ends by end plates 37 which are offset as at 38 between their opposite side edges to form a flat section 39 provided with a pair of openings 40 corresponding exactly to the openings 26.

As is best shown in FIG. 7, the units 8 and 9 may be assembled with one another to form the structural members 7. The assembly process comprises first assembling the members 11 and 12 with the respective struts 20 and end plates 23 in the manner illustrated in FIGS. 2 and 3. Preferably, all of the parts are assembled and secured to one another by use of spot welding equipment. The members 28 and 29 of the unit 9 are secured to the respective struts 36 and end plates 37 in the same manner as are the elements of the unit 8. When fully assembled the openings 26 and 40 in the end plates are in register.

Following the assembly of the units 8 and 9, such units may be assembled with one another to form the structural member 7 by placing the flanges 13 and 16 back to back with the flanges 30 and 33 and the end plates 23 and 37 back to back. The respective flanges and end plates then may be spot welded together to form a rigid, assembled structural member 7. In assembled relation the lower end of each strut 20 is adjacent the lower end of each strut 36 and the upper end of each strut 20 is adjacent the upper end of each strut 36. The struts 20 and 36, therefore, present zig-zag appearance.

As is best shown in FIGS. 1 and 7, the flanges 14 and 31 of an assembled member 7 extend in prolongation of one another in opposite directions from the respective flanges 13 and 30, and the flanges 17 and 34 extend in opposite directions from the respective flanges 16 and 33. As shown in FIG. 7, the member 7 has flanges 17 and 34 that are not perpendicular to the respective struts, but parallel the flanges 14 and 31. As shown in FIG. 11, however, a member **7*a* can be used in some instances. The member 7*a* is like the member 7 but has flanges 4*a*, 17*a* and 31*a*, 34*a*** that are perpendicular to the respective struts.

It is not necessary that the flanges at the upper and lower chords of the members 7 be coplanar. As is shown in FIG. 1, a member **7*b* at the center of the roof truss has its upper and lower flanges positioned at an angle with respect to each other. In all other respects, however, the structural member 7*b* is the same as the members 7**.

Each vertical brace 5 of the truss 2 is a T-shaped member having two pairs of vertically spaced button head studs 41 adjacent its upper end. The heads of the studs 41 are of such size as to pass through the opening in the larger ends of the openings 26, 40, but are too large to pass through the smaller ends of the openings. The respective structural members 7 may be assembled with the vertical braces 5 by passing the button head studs through the openings 26, 40 and permitting the members 7 to move downwardly by gravity creating a wedged relationship between the studs and the edges of the openings, thereby firmly securing the end plates to the braces 5. As is conventional, the top chord 4 of the strut has a T-shaped flange 42 that is accommodated between the confronting ends of each pair of members 12.

The structural joist/girt/purlin members disclosed herein have many advantages over conventional members utilized for the same purposes. For example, the sections from which the structural members are made are cold formed and correspondingly less expensive than hot rolled beams, channels, angles, and the like. Moreover, the utilization of spaced apart struts, as opposed to solid C, Z, or I beam sections is more economical. Further, the chord and strut shapes may be changed as needed for assembly or aesthetic purposes, i.e., to vary the roof design, slope, or structural strength.

Since all manufacturing and assembly operations are simple, they lend themselves to automated procedures utilizing robots with very little or no manual handling.

The button head stud connections of the structural members to the trusses enables significant economies to be achieved inasmuch as such connections eliminate labor-intensive bolting and welding operations. The use of two vertically spaced button headed stud connections at each end of each structural member also provides lateral support for the building frame, thereby reducing the need for installation of separate bracing members.

The inclination or slope of the top chord of the structural member can be perfectly formed in a shop utilizing appropriate fixtures, thereby matching perfectly the pitch to which the roof is to be formed. The same observation applies with respect to the flanges forming the bottom chord with the additional advantage that, if desired, the bottom chord can parallel the top chord or be horizontal. In either case, the bottom chord permits the direct application of insulation and ceiling material either horizontally or parallel with the roof.

Of particular significance is the fact that, although the upper and lower chords of the structural member may be inclined to the horizontal at an angle corresponding to the pitch of the roof, the web of such structural member extends vertically. As a result, the weight supporting axis and the axis of the structural member are vertical so that the member is at maximum efficiency without being subjected to torsional stress.

The terms "vertical" and "horizontal" have been used herein for convenience in the description of the invention as disclosed in the drawings. These terms are not intended as limitations.

The disclosed embodiment is representative of a presently preferred form of the invention, but is intended to be illustrative rather than definitive thereof. The invention is defined in the claims.

I claim:

1. A structural member for use in the construction of a building, said member comprising an upper chord; a lower chord, said chords being of substantially equal length and vertically spaced from one another; an end plate at each end of said member joined to and maintaining said chords in spaced apart, substantially parallel relation; and a plurality of diagonal struts secured to and extending vertically between said chords at spaced intervals, each of said chords extending in opposite directions laterally of said struts at a selected angle thereto, each of said chords comprising a pair of angular elements each of which has a vertical first flange and a second flange extending at an angle from said first flange, the vertical flanges of said elements being secured to one another and the second flanges of said elements extending in prolongation of each other.

2. A structural member according to claim 1 wherein each of said chords is inclined at an angle to the horizontal.

3. A structural member according to claim 1 wherein said lower chord substantially parallels said upper chord.

4. A structural member according to claim 1 wherein a first group of said struts are secured at their opposite ends to corresponding flanges of said upper and lower chords and a second group of said struts are secured at their opposite ends to corresponding flanges of the other of said elements.

5. A structural member according to claim 4 wherein all of the struts of said first group are inclined and parallel to one another and all of the struts of said second group are inclined and parallel to one another, the inclination of the struts of said groups being reversed.

6. A structural member according to claim 1 wherein each of said struts is flat at its opposite ends and of angular cross section between its ends.

7. A structural member according to claim 1 wherein each of said end plates has at least one opening therein for the accommodation of a fastener.

8. A structural member according to claim 1 wherein each of said end plates has two vertically spaced openings therein.

9. A structural member according to claim 8 wherein each of said openings tapers in a direction toward said upper chord.

10. A structural member for use in constructing a roof having a selected pitch, said member comprising a first pair of elements each of which has a pair of angularly disposed flanges; means securing one flange of one of said elements in back to back relation with one flange of the other of said elements, the other flanges of said elements extending in opposite directions away from their secured flanges, said first pair of elements forming an upper chord; a second pair of elements each of which has a pair of angularly disposed flanges; means securing one flange of one of the elements of said second pair of elements in back to back relation with a flange of the other element of said second pair of elements, the other flanges of the elements of said second pair of elements extending in opposite directions away from their secured flanges, said second pair of elements forming a lower chord; a first group of struts secured at their opposite ends to said upper and lower chords respectively, all of said struts of said first group being inclined at a substantially uniform angle to the vertical and being spaced from one another longitudinally of said upper and lower chords; and a second group of struts secured at their opposite ends to said upper and lower chords respectively, all of the struts of said second group being inclined at a substantially uniform angle to the vertical and being spaced from one another longitudinally of said chords, the inclination of the struts of said groups of struts being reversed.

11. A structural member according to claim 10 wherein the struts of said first group have their upper ends secured to said top chord and their lower ends secured to said bottom chord, and wherein the struts of said second group have their upper ends secured to said upper chords adjacent the upper ends of the struts of said first group and their lower ends secured to the lower chord adjacent the lower ends of the struts of said first group.

12. A structural member according to claim 11 wherein said struts are of substantially uniform length.

13. A structural member according to claim 10 wherein each of said struts is flat at its opposite ends.

14. A structural member according to claim 13 wherein each of said struts is of angular cross section between its ends.

15. A structural member according to claim 10 including end plates spanning and joined to each of said upper and lower chords at opposite ends thereof.

16. A structural member according to claim 15 wherein each of said end plates has a pair of openings therein for the accommodation of a fastener, each of said openings tapering in a direction toward said upper chord.

17. A structural member according to claim 10 wherein said other flanges of said first pair of elements are inclined to their respective first flanges at an angle corresponding to said selected pitch.

18. A structural member according to claim 17 wherein said other flanges of said second pair of elements are inclined to their respective first flanges and substantially parallel said other flanges of said first pair of elements.

19. A structural member according to claim 17 wherein said other flanges of said second pair of elements extend at substantially 90° from their respective first flanges.

20. A structural member for use in the construction of a building, said member comprising an elongate upper chord; an elongate lower chord, said chords being vertically spaced from one another, each of said chords comprising a pair of angular elements each of which has a vertical first flange and a second flange extending from said first flange at an angle thereto, the vertical flanges of said elements being secured directly to one another in back to back relation and the second flanges of said elements extending in prolongation of each other; and a plurality of struts secured to and extending diagonally between said chords at spaced intervals, a first group of said struts being secured at their opposite ends to the vertical flanges of said upper and lower chords at corresponding sides thereof and a second group of said struts being secured at their opposite ends to the vertical flanges of said upper and lower chords at corresponding opposite sides thereof.

21. A structural member according to claim 20 wherein all of the struts of said first group are inclined and parallel to one another and all of the struts of said second group are inclined and parallel to one another, the inclination of the struts of said groups being reversed.

22. A structural member according to claim 20 wherein each of said struts is flat at its opposite ends and of angular cross section between its ends.

23. A structural member according to claim 20 including an end plate joining said chords at each end of said member and maintaining said chords in spaced apart relation.

24. A structural member according to claim 20 wherein the second flanges of the upper chord extend in prolongation of one another and the second flanges of the lower chord extend in prolongation of each other, the angle between the first and second flanges of the upper chord being substantially the same and the angle between the first and second flanges of the lower chord being substantially the same but different from the angle between the first and second flanges of the upper chord.

* * * * *

UNITED STATES PATENT AND TRADEMARK OFFICE

CERTIFICATE OF CORRECTION

PATENT NO. : 4,887,406

DATED : December 19, 1989

INVENTOR(S) : Wilburn H.F. Saia

It is certified that error appears in the above-identified patent and that said Letters Patent is hereby corrected as shown below:

In column 2, line 15, after "two" insert -- structural members --.

Signed and Sealed this

Thirteenth Day of November, 1990

*Attest:*

HARRY F. MANBECK, JR.

*Attesting Officer*

*Commissioner of Patents and Trademarks*